US007322715B1

(12) United States Patent
Liu

(10) Patent No.: US 7,322,715 B1
(45) Date of Patent: Jan. 29, 2008

(54) SELF-LIGHT-UP DECORATING LAMP

(76) Inventor: Tung-Chang Liu, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 11/604,119

(22) Filed: Nov. 27, 2006

(51) Int. Cl.
*F21L 4/00* (2006.01)

(52) U.S. Cl. ..... 362/183; 362/806; 362/367; 362/154

(58) Field of Classification Search ..... 362/183, 362/806, 367, 154, 227, 249, 251, 253
See application file for complete search history.

(56) References Cited

U.S. PATENT DOCUMENTS

2003/0103345 A1* 6/2003 Nolan ..... 362/157
2003/0221377 A1* 12/2003 Crawford et al. ..... 52/103
2004/0170013 A1* 9/2004 Smythe ..... 362/184
2005/0030764 A1* 2/2005 Spero et al. ..... 362/559
2006/0050528 A1* 3/2006 Lyons et al. ..... 362/559

* cited by examiner

*Primary Examiner*—Laura Tso

(57) ABSTRACT

A self-light-up decorating lamp, comprises a decoration body; and an illumination device installed to the decoration body; the illumination device including a solar plate, a battery, an LED lamp set, a light-sensitive resistor, a switch and a LED lamp set; the solar plate being installed at an outer side of the decoration body for receiving solar or other light energy to convert the energy into electric energy; one end of the battery being connected to the light-sensitive resistor and the switch; one end of the switch being connected to the LED lamp set and the LED lamp set is installed on the decoration body. The decoration body has a form selected from an advertise board, an indication board, an announcement board, and a display board. The solar plate receives electric energy which is converted from solar or light energy. The light-sensitive resistor serves to actuate the LED lamp set.

1 Claim, 4 Drawing Sheets

SELF-LIGHT-UP DECORATING LAMP

FIELD OF THE INVENTION

The present invention relates to illumination, and particularly to a self-light-up decorating lamp. A solar plate is used to convert light energy into electric energy and the power can be saved in a battery. A light-sensitive resistor is used to actuate an LED lamp set automatically so that power is saved. The present invention comprises a decoration body; and an illumination device installed to the decoration body; the illumination device including a solar plate, a battery, an LED lamp set, a light-sensitive resistor, a switch and a LED lamp set.

BACKGROUND OF THE INVENTION

In general, the decoration objects, such as advertise decorations, announcement decorations (for example, Christmas decorations, or other special festival decorations) must be connected to power sources as light effect is needed. The power is actuated manually. If in daytime, or illumination is low, it is very often that the power source is not de-actuated. Thus power is wasted.

SUMMARY OF THE INVENTION

Accordingly, the primary object of the present invention is to provide a self-light-up decorating lamp, wherein a light-sensitive resistor is used to control the opening or closing the self-light-up decorating lamp and thus the power is saved.

To achieve above objects, the present invention provides a self-light-up decorating lamp which comprises a decoration body; and an illumination device installed to the decoration body; the illumination device including a solar plate, a battery, an LED lamp set, a light-sensitive resistor, a switch and a LED lamp set; the solar plate being installed at an outer side of the decoration body for receiving solar energy or other light energy to convert the energy into electric energy; one end of the battery being connected to the light-sensitive resistor and the switch; one end of the switch being connected to the LED lamp set and the LED lamp set is installed on the decoration body. The decoration body has a form selected from an advertise board, an indication board, an announcement board, and a display board. The decoration body is connected to the illumination device, the solar plate receives electric energy which is converted from solar or light energy, and then the electric energy is stored in the battery, if the switch is switched to the light-sensitive resistor. Then the light-sensitive resistor serves to actuate the LED lamp set according to the state of light.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
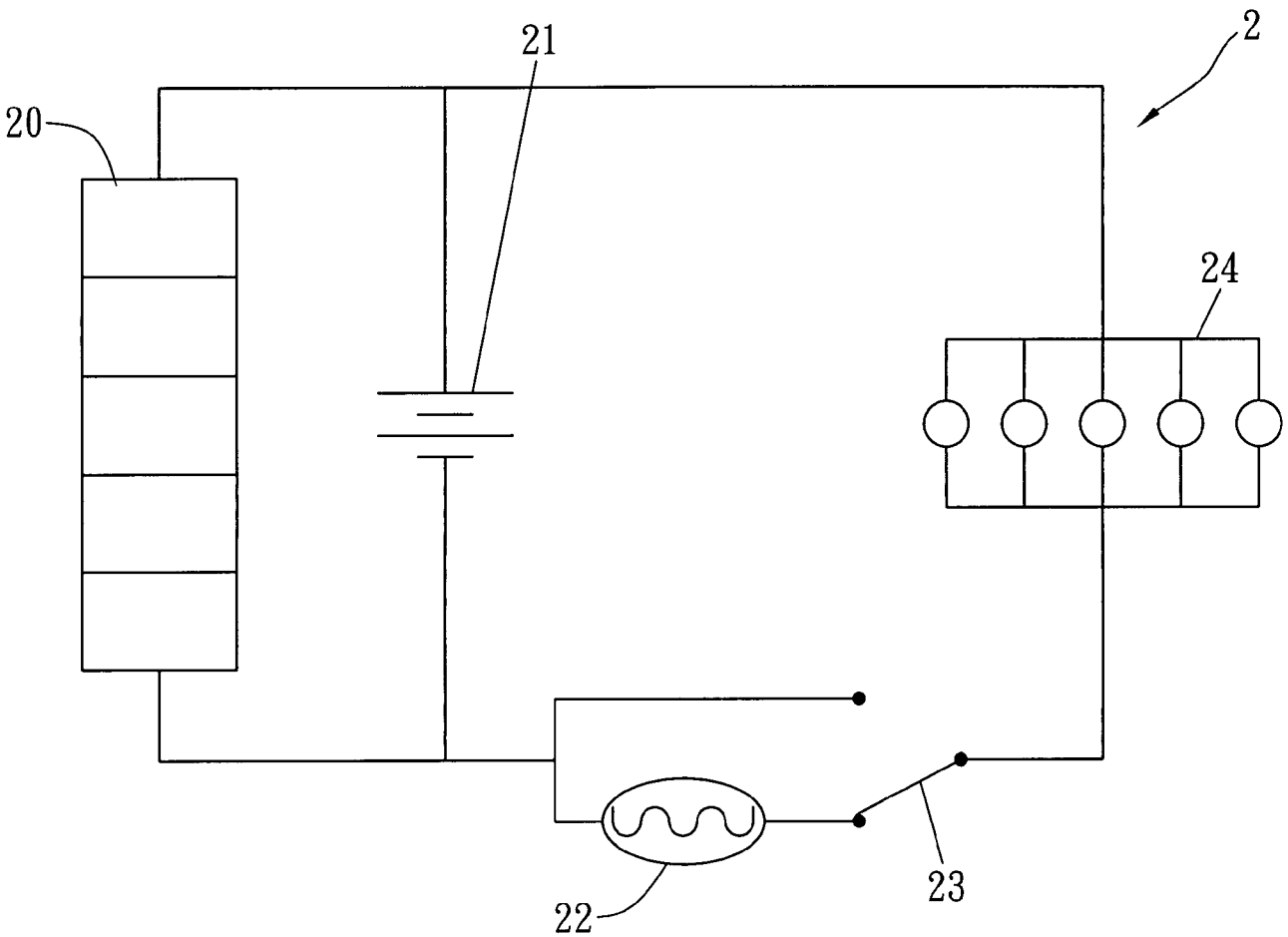
FIG. 1 is a structural view of the present invention.
Figure 2:
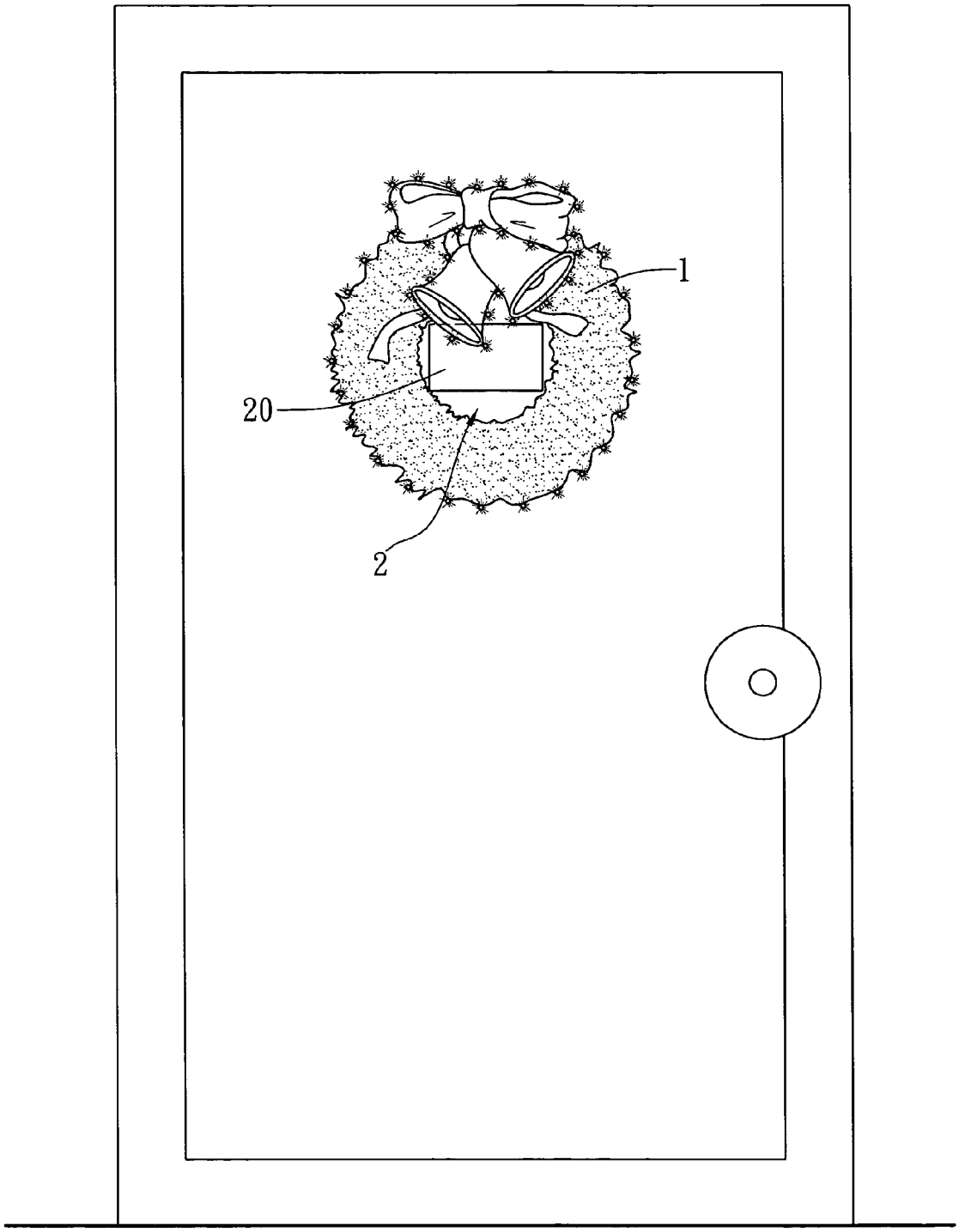
FIG. 2 is a schematic view showing one embodiment of the present invention.

Referring to FIGS. 1 and 2, the structure of the present invention is illustrated. The present invention has the following elements.

A decoration body 1 has a predetermined shape which may be one of an advertise board, an indication board, an announcement board, a display board, etc.

Figure 3:
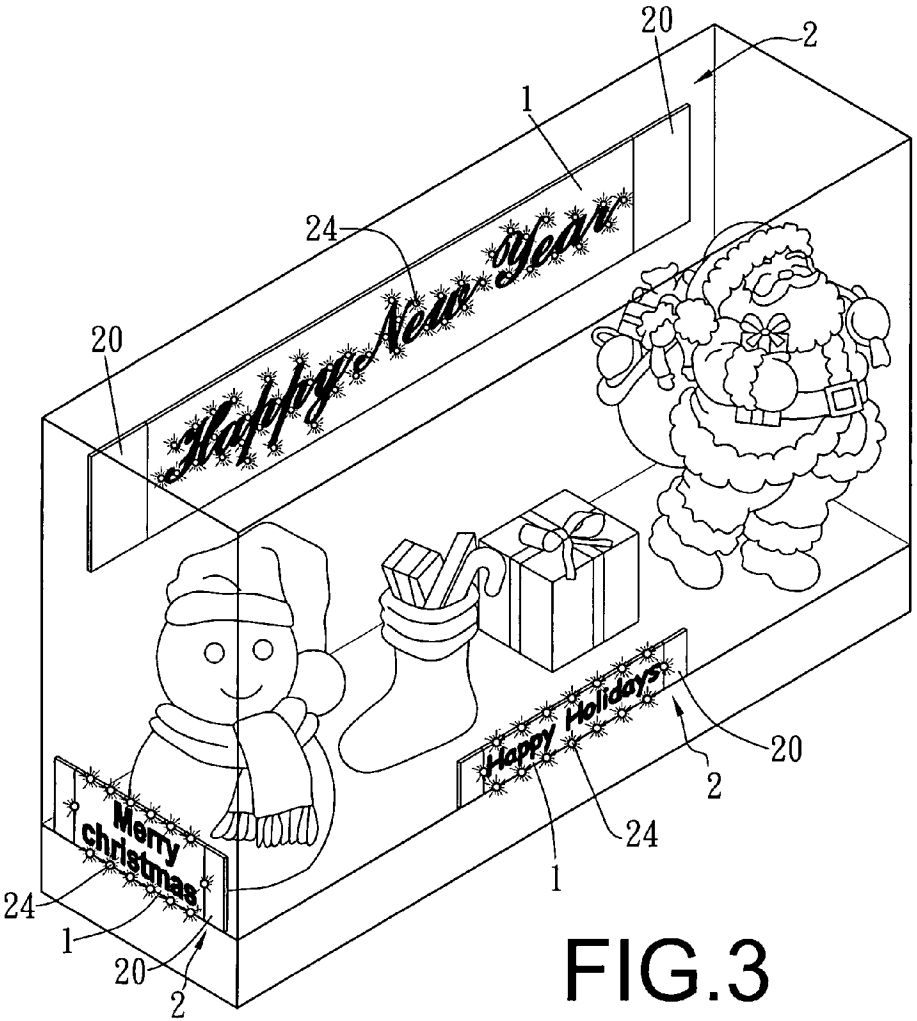
FIG. 3 is a schematic view about another embodiment of the present invention.
Figure 4:
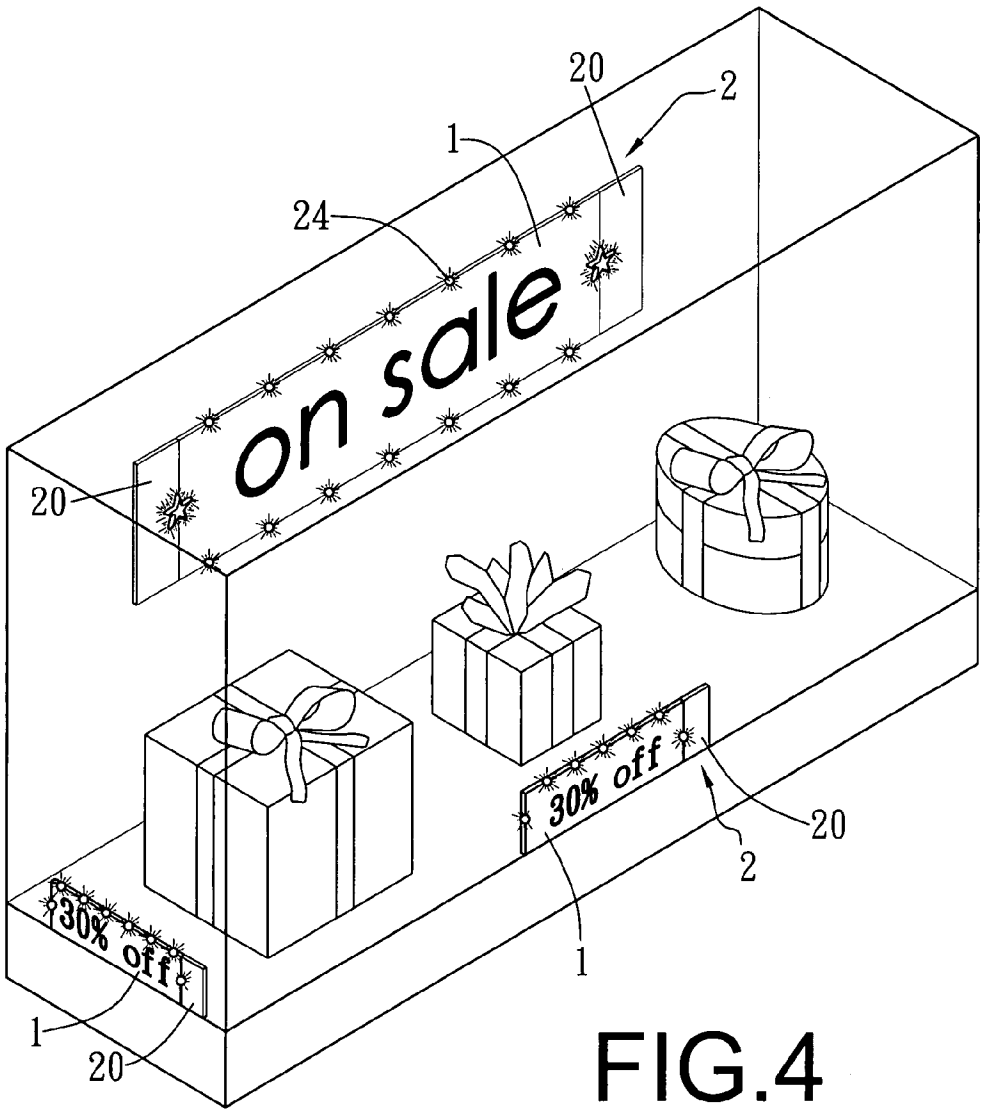
FIG. 4 is a schematic view showing a further embodiment of the present invention.

An illumination device 2 is assembled to the decoration body 1. The illumination device 2 includes a solar plate 20, a battery 21, an LED lamp set 24, a light-sensitive resistor 22, a switch 23 and a LED lamp set 24. The solar plate 20 is installed at an outer side of the decoration body 1 for receiving solar energy or other light energy to convert the energy into electric energy. One end of the battery 21 is connected to the light-sensitive resistor 22 and the switch 23. One end of the switch 23 is connected to the LED lamp set 24 and the LED lamp set 24 is installed on the decoration body 1. Furthermore, referring to FIG. 3, in the present invention, at least one decoration in the decorating lamp; and the solar plate 20 is adhered aside a plate installed with LED lamp set 24;

In use, with reference to FIGS. 1 to 4, in the decoration body 1 connected to the illumination device 2, the solar plate 20 receives electric energy which is converted from solar energy or light energy. Then the electric energy is stored in the battery 21. When it is desired to make the light-sensitive resistor 22 to control the LED lamp set 24, the switch 23 is switched to the light-sensitive resistor 22. Then the light-sensitive resistor 22 serves to actuate the LED lamp set 24. That is, by the property of the light-sensitive resistor 22, the present invention is sensitive to light. When in the weak light state, the LED lamp set 24 is light up. On the contrary, when light is sufficient as in the daytime, the power source is closed. Thus the power source is controlled automatically. Besides, when it is desired to make the switch 23 is not controlled by the light-sensitive resistor 22, the LED lamp set 24 will light up whole day. Thus the user can control the state as desired.

Therefore, in the present invention, the solar plate 20 serves to convert the solar energy into electric energy and then stores the electric energy into the battery 21. The light-sensitive resistor 22 is used as an auto-control device of the switch 23. Not only the power can be supplied by itself and no external power source is necessary. The light-sensitive resistor 22 serves to control the power up of the device. The light-sensitive resistor 22 lights up in weak light state. Thus the power is saved.

Furthermore by the decoration body 1 of the present invention, in night, the self-light-up decorating lamp of the present invention will light up as an advertise board, an indication board, an announcement board, a display board, etc. so as to form a beautiful visual feeling.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A self-light-up decorating lamp, comprises a decoration body being a transparent box; and an illumination device installed to the decoration body; the illumination device including a solar plate, a battery, an LED lamp set, a light-sensitive resistor, and a switch; the solar plate being installed at an outer side of the decoration body 1 for receiving solar energy or other light energy to convert the energy into electric energy; one end of the battery being connected to the light-sensitive resistor and the switch; one end of the switch being connected to the LED lamp set and the LED lamp set being installed on the decoration body;

at least one decoration in the decorating lamp in the transparent decorating box;

wherein the solar plate is adhered aside a plate installed with LED lamp set;

wherein the decoration body is connected to the illumination device, the solar plate receives electric energy which is converted from solar energy or light energy, and then the electric energy is stored in the battery, if the switch is switched to the light-sensitive resistor, the light-sensitive resistor serves to actuate the LED lamp set according to the state of ambient light.

* * * * *